US006345670B1

(12) United States Patent
Sundholm

(10) Patent No.: US 6,345,670 B1
(45) **Date of Patent: *Feb. 12, 2002**

(54) SPRAY HEAD

(76) Inventor: Göran Sundholm, Ilmari Kiannon Kuja 3, FIN-04310, Tuusula (FI)

( * ) Notice: Subject to any disclaimer, the term of this patent is extended or adjusted under 35 U.S.C. 154(b) by 0 days.

This patent is subject to a terminal disclaimer.

(21) Appl. No.: 09/535,383

(22) Filed: Mar. 24, 2000

(30) Foreign Application Priority Data

Oct. 8, 1999 (FI) ..... 19992173

(51) Int. Cl.[7] ..... A62C 37/08

(52) U.S. Cl. ..... 169/37; 169/38; 169/42; 169/19; 169/26; 169/56; 169/57; 169/59; 169/60

(58) Field of Search ..... 169/37, 38, 41, 169/42, 19, 26, 56, 57, 59, 60

(56) References Cited

U.S. PATENT DOCUMENTS

| | | | | |
|---|---|---|---|---|
| 399,159 A | * | 3/1889 | Grinnell | 169/37 |
| 1,837,322 A | * | 12/1931 | Hamilton | 169/37 |
| 2,327,528 A | * | 8/1943 | Kendall et al. | 169/37 |
| 2,389,331 A | * | 11/1945 | Tyden | 169/37 |
| 3,727,695 A | * | 4/1973 | Danton | 169/37 |
| 4,014,388 A | | 3/1977 | Anderson | 169/37 |
| 4,015,665 A | | 4/1977 | Simmons et al. | 169/40 |
| 4,880,063 A | | 11/1989 | Leininger et al. | 169/37 |

FOREIGN PATENT DOCUMENTS

| | | |
|---|---|---|
| WO | 95/31252 | * 11/1995 |

* cited by examiner

*Primary Examiner*—David A. Scherbel
*Assistant Examiner*—Robin O. Evans
(74) *Attorney, Agent, or Firm*—Ladas & Parry

(57) ABSTRACT

The invention relates to a spray head comprising a holder body (3'), at least one nozzle (2', 2c') and a cover (13') which in a protective position is arranged in front of said nozzle when the spray head is in an inactive mode, the spray head comprising means (6', 10') for providing a displacement of the cover from the protective position to a free position in which the cover keeps clear of the nozzle so that it can spray extinguishing medium when the spray head is in an active mode, the holder body comprising an inlet (5') for incoming extinguishing medium. In order for the spray head to be able to be installed and operate in surroundings where it is exposed to dirt and impurities for long periods of time, the spray head is characterized in that the means for providing the displacement of the cover (13') comprises a device (6') which is displaceable with respect to the spray heat and which by means of fluid pressure is arranged to exert a force on a locking device (14', 17') in the cover (13') to make the locking device open and consequently displace the cover to said free position.

26 Claims, 5 Drawing Sheets

4
5'
45'
30'
48'
6'
8'
26'
24'
10'
9'
23'
25'
15'
14'
13'
42'
54'
55'
28'
58'
57'
53'
52'
51'
50'
2c'
2'
1'
17'
16'
27'
41'
40'
47'
7'
3'
46'
49'

SPRAY HEAD

BACKGROUND OF THE INVENTION

The invention relates to a spray head comprising a holder body, at least one nozzle and a cover which in a protective position is arranged in front of said nozzle when the spray head is in an inactive mode, the spray head comprising means for providing a displacement of the cover from the protective position to a free position in which the cover keeps clear of the nozzle so that it can spray extinguishing medium when the spray head is in an active mode, the holder body comprising an inlet for incoming extinguishing medium.

Such spray heads are known for example from U.S. Pat. No. 4,014,388 and U.S. Pat. No. 4,880,063. The cover serves to provide an aesthetically appealing sprinkler of a type which in an inactive mode is concealed in a ceiling, for example. In such concealed sprinklers, the cover mainly serves to keep a deflect plate in a retracted position for aesthetic reasons.

In these known sprinklers, the cover falls downwards when the material holding the cover in position melts as it is exposed to heat. Once the cover falls, the heat-activated release means of the sprinkler immediately comes into contact with heat, releasing the sprinkler.

In certain surroundings, the spray heads are exposed to dust, deposits and other material that can prevent the supply of extinguishing medium in a fire by clogging the spray head nozzles. Spray heads and sprinklers are installed in order that they operate, when required, up to several years after installation and, consequently, they are naturally exposed to dirt in certain surroundings. A cover in the form of a plate (cf. U.S. Pat. No. 4,014,388 and U.S. Pat. No. 4,880,063, for example) installed in front of the nozzles mainly provides mechanical protection against impacts. Some protection against dirt may be provided, but these known sprinklers are mounted in surroundings where dirt is no problem. In certain surroundings, the amount of dirt and impurities is so high that no spray heads at all have been mounted, the assumption being that they would not operate reliably. This is the case although spray heads are most desirable in some of these applications. As examples may be mentioned open rail cars transporting expensive equipment that may catch fire, for example vehicles. Other applications include painters' workshops and steel plants.

Mechanical loads can also make the nozzles of a spray head inoperative. Such mechanical loads may be created by impacts caused by trucks, lorries etc. in industrial halls, garages and on car decks onboard ferries.

BRIEF DESCRIPTION OF THE INVENTION

The object and idea of the invention is to provide a spray head without said drawbacks and which, therefore, can be used in difficult, typically dirty, surroundings and which has a simple structure. The structure of the sprinkler is typically such that nozzles and other components are simultaneously protected from dirt, dust, deposits and other material which may prevent the spray head from supplying extinguishing medium.

For the above purposes, the present invention provides a spray head comprising a holder body, at least one nozzle and a cover which in a protective position is arranged in front of said nozzle when the spray head is in an inactive mode, the spray head comprising means for providing a displacement of the cover from the protective position to a free position in which the cover keeps clear of the nozzle so that it can spray extinguishing medium when the spray head is in an active mode, the holder body comprising an inlet for incoming extinguishing medium, wherein the means for providing the displacement of the cover comprises a device which is displaceable with respect to the spray heat and which is arranged by means of fluid pressure to exert a force on a locking device in the cover to make the locking device open and consequently displace the cover to said free position.

In a structurally simple embodiment of the invention, the cover is arranged to place the spray head in the active mode during the displacement.

The displaceable device preferably has a projection area which is arranged to exert the force on the locking device under fluid pressure in a pressure chamber.

The displaceable device preferably comprises a sleeve-like part which together with the holder body defines the pressure chamber, the sleeve-like part comprising the projection area in the area of the pressure chamber. Such a structure is simple and operatively reliable.

The pressure chamber can be in fluid communication with the inlet via a passage when the spray head is in the inactive mode. This being the case, an extinguishing medium pressure in the inlet provides said force against the locking device. This provides an extremely simple way for the spray head to shift to the active mode. Alternatively, according to an extremely advantageous embodiment of the invention, the pressure chamber is in connection with a control line via a passage, so that a fluid pressure in the control line is arranged to provide said force against the locking device. This embodiment is particularly suitable for so-called wet pipe systems in which the pipes are filled with pressurized extinguishing medium, and an extinguishing medium pressure acts in the inlet to the spray head without this pressure as such, i.e. without the pressure in the control line, being able to make the spray heat to shift to the active mode in which it sprays extinguishing medium.

When a sleeve-like part is used, it is preferably composed of a cylindrical part comprising a first cylindrical inner surface and a second cylindrical inner surface in the area of the pressure chamber, the first cylindrical inner surface having a larger diameter than the second cylindrical inner surface so that a shoulder forms between said cylindrical inner surfaces, the shoulder defining said projection area as a ring area. Such a cylindrical part is easy to make and easy to attach to the holder body. Furthermore, in this case the sleeve-like part is preferably sealed against the holder part by a first ring seal positioned in the first cylindrical inner surface and a second ring seal positioned in the second cylindrical inner surface in such a manner that the fluid supplied to the pressure chamber cannot flow out of the pressure chamber.

When a sleeve-like part is used, it preferably comprises a third cylindrical inner surface arranged to bear tightly against a third ring seal when the sprinkler is displaced to the active mode. This provides extra sealing against leakage; both the first and third ring seals seal against leakage.

The cover is preferably fluid-tight and hermetically arranged against the spray head by means of a seal which is preferably composed of the third ring seal. This provides the spray head with effective protection against dirt. The cover preferably comprises a cylindrical groove for the third ring seal, which groove and ring seal hold the cover in place in said protective position.

The preferred embodiments of the invention are disclosed in the attached claims 2 to 26.

One of the major advantages of the spray head is that it can be used in applications in which spray heads have not been considered to operate reliably up to now, and have therefore never been installed. In such applications the spray head of the invention is able to operate without problems. The shift of the spray head from the inactive to active mode can be achieved manually or by means of different detection systems very rapidly in different ways by means of fluid pressure. The fluid pressure can be produced for example manually by starting a pump which supplies fluid to the spray head or manually by opening a valve for supplying fluid to the spray head. The fluid pressure can be provided by means of fire detectors (e.g. smoke, heat or flame detectors) which give a signal to activate the equipment. The signal can be given to a pump which starts to supply extinguishing medium to the spray head, or the detector can be arranged to give a signal to a valve which opens so as to supply fluid (extinguishing medium, for example) to the spray head. The sensitive components of the spray head, such as nozzles, are protected against dirt, deposits and mechanical impacts. The structure of the spray head is very simple.

BRIEF DESCRIPTION OF THE DRAWINGS

In the following the invention will be described with reference to the attached drawing, in which.

DETAILED DESCRIPTION OF THE INVENTION

Figure 1:
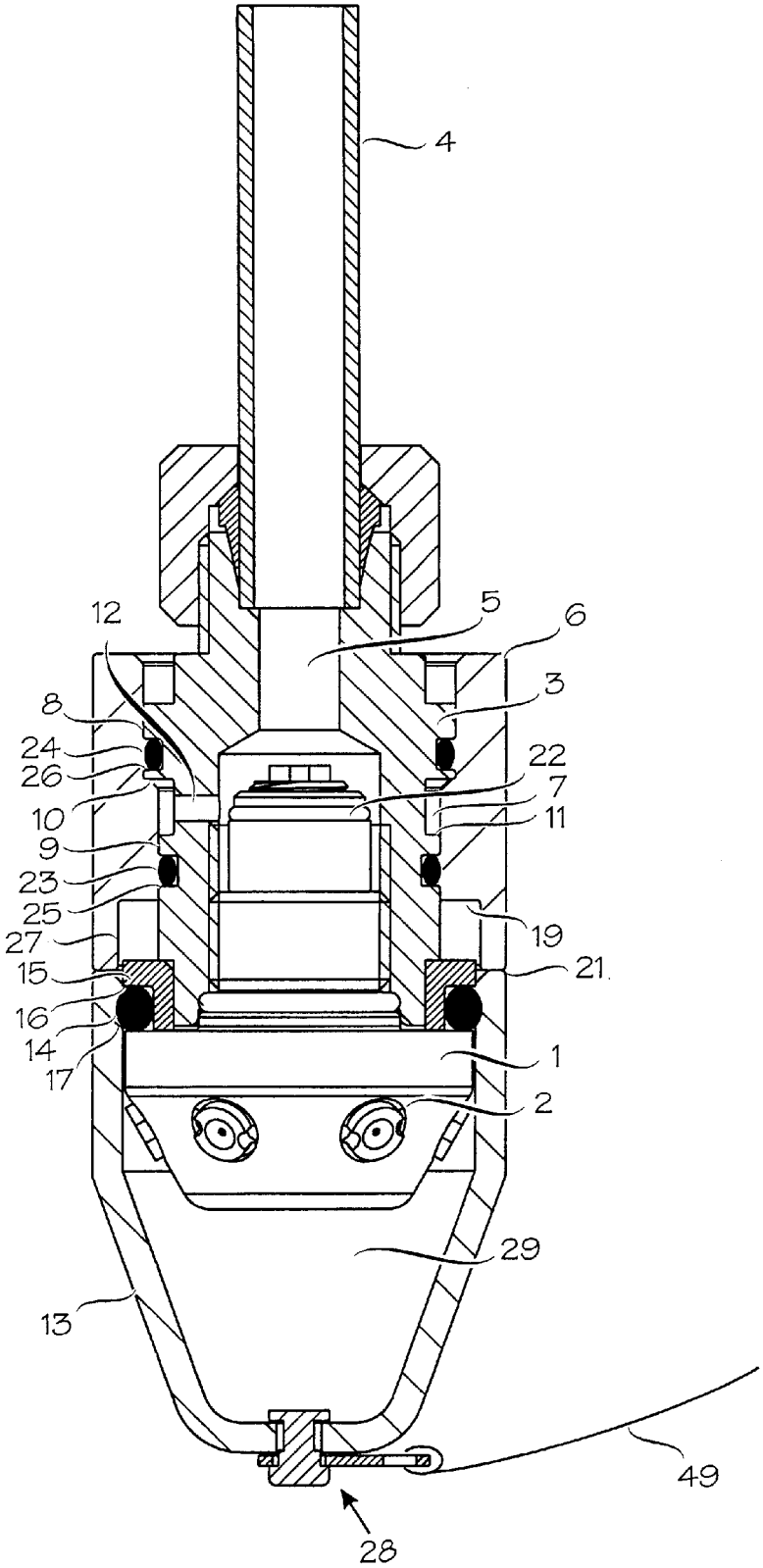
FIG. 1 shows the spray head of the invention in a first, inactive mode.

FIG. 1 shows the spray head of the invention in a first, inactive mode. The spray head comprises a holder body 3 and a nozzle frame 1 fastened thereto by means of a spindle and comprising a number of nozzles 2. The holder body 3, in turn, is fastened to a pipeline 4 which supplies extinguishing medium to an inlet 5 in the holder body 3 and further to an upper portion 22 in the nozzle frame.

The holder body 3 is enclosed in a cylindrical sleeve 6. The sleeve 6 is displaceable with respect to the holder body 3. A pressure chamber 7 is arranged between the sleeve 6 and the holder body 3. The pressure chamber 7 is formed because the sleeve 6 has a second cylindrical inner surface 8 whose diameter is larger than a first cylindrical inner surface 9 of the sleeve. The passage between the cylindrical surfaces 8 and 9 define a shoulder 10. The pressure chamber 7 is also defined by a ring groove 11 provided in the holder body 3.

The pressure chamber 7 is in contact with the inlet 5 via a passage which is generally denoted by reference numeral 12.

The sleeve 6 is sealed against the holder body 3 by means of a first ring seal 23 in the first cylindrical inner surface 9 and a second ring seal 24 in the second cylindrical inner surface 8. The ring seals 23, 24 are attached to ring grooves 25 and 26, respectively, in the holder body 3. This provides a simple structure. The sleeve 6 has corresponding, but shallow, ring grooves for the ring seals 23, 24, the grooves being provided in the first cylindrical inner surface 9.

The spray head comprises a cup-shaped cover 13 which covers the nozzles 2 and is installed by means of a ring seal 14 against a flange-like part 15 which, in turn, is fastened to the holder body 3. The flange-like part 15 forms a ring groove 16 for the ring seal 14. The cover 13 comprises a cylindrical groove 17 for receiving the ring seal 14. The ring seal 14 is suitably somewhat pressed between the ring groove 16 and the cylindrical groove 17. The cylindrical groove 17 and the ring seal 14 can be said to provide a locking device which holds the cover 13 in place in a protective position. Because of the ring seal 14, the cover 13 is not only steadily attached to the spray head, but also the important components of the spray head, such as the nozzles 2, are protected and hermetically sealed from the surroundings of the spray head. This is important since the spray head is intended to be used in various surroundings in which it is exposed to dirt which with time renders the spray head unusable or causes its operation to become unreliable without said cover 13.

In FIG. 1, the cover 13 is in a protective position. The spray head in FIG. 1 can be placed in an active mode, shown in FIG. 3, by supplying pressurized liquid from the pipeline 4 to the passage 12. This way a liquid pressure is created against the shoulder 10 (see FIG. 1), creating a force which tends to push the sleeve 6 downwards. The magnitude of the force is determined by the product of the liquid pressure and the projecting ring area that the shoulder 10 defines, seen in the longitudinal direction of the holder body (i.e. that of the pipeline 4). When the magnitude of the force exceeds the force needed to open the locking device created by the ring seal 14 and the groove 17, the cover 13 comes off and is displaced by being pressed by the lower edge 21 of the sleeve in the position shown in FIG. 2.

Figure 2:
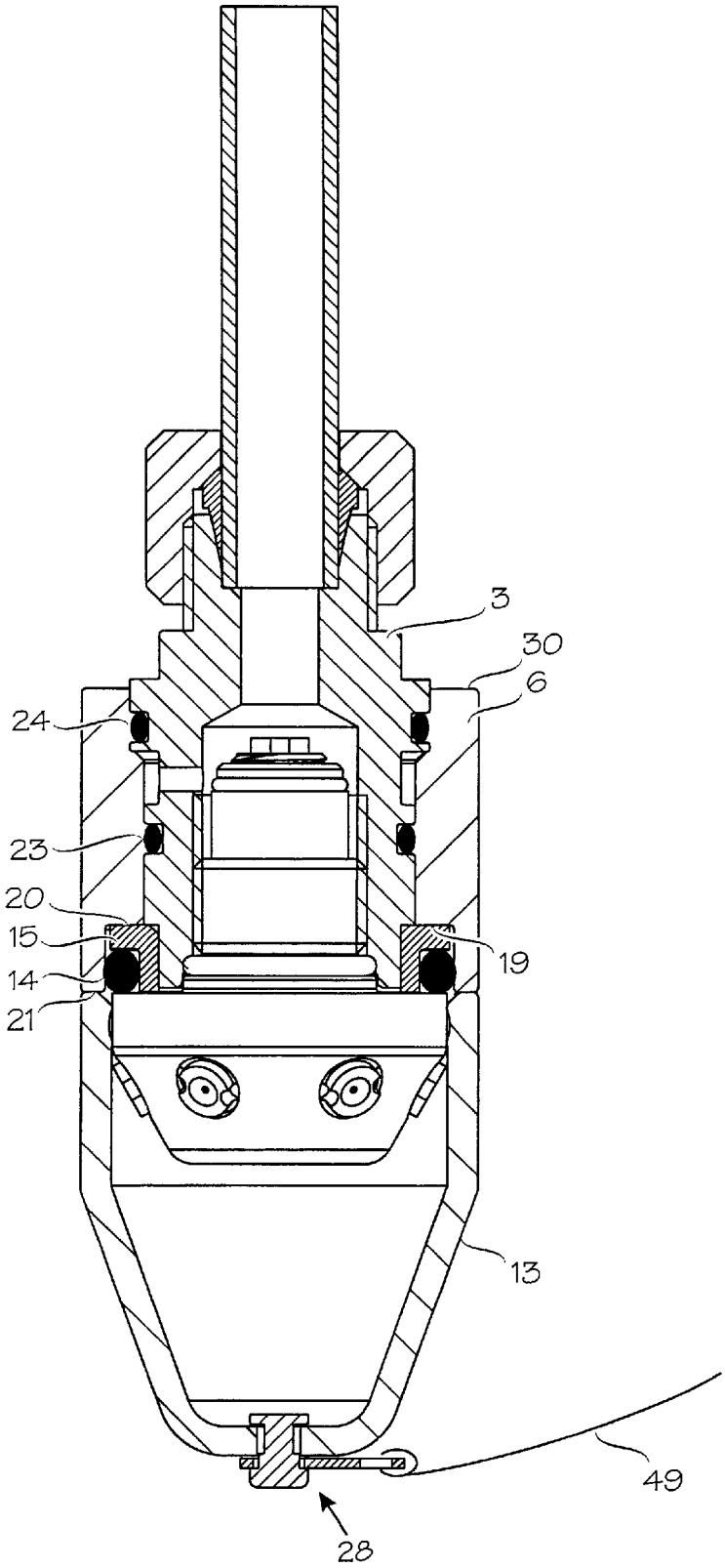
FIG. 2 shows the spray head of FIG. 1 in an intermediate mode.

FIGS. 2 and 1 shows that the sleeve 6 comprises a stop 19 which bears on the flange-like part 15. Consequently, the flange-like part can be called a blocking part 15.

Figure 3:
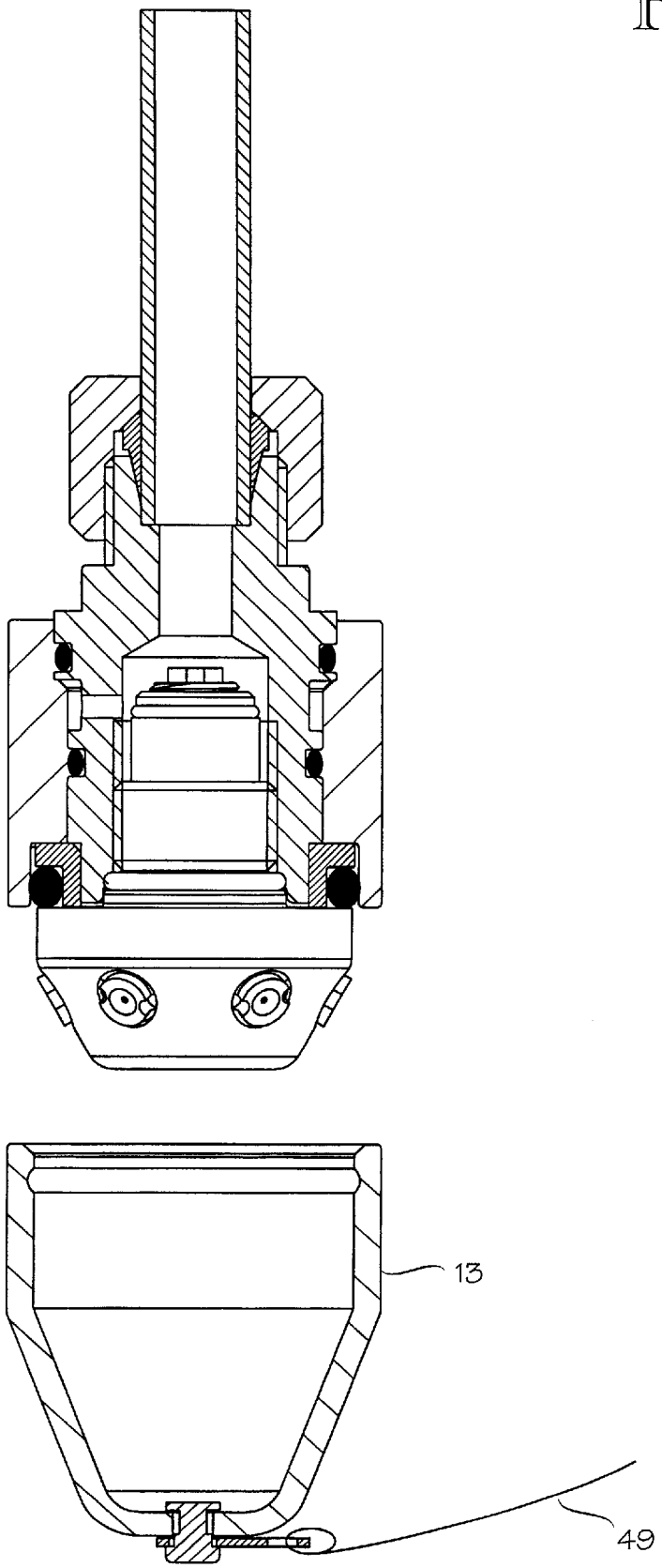
FIG. 3 shows the spray head of FIG. 1 and 2 in an active mode.

With the cover 13 in the position shown in FIG. 2, it falls from the spray head, is released from the sleeve 6 and is placed in a free position, as is shown in FIG. 3. This way the spray head is in the active mode and is able to spray extinguishing medium.

The sleeve 6 comprises a third cylindrical inner surface 27 which is arranged to bear tightly on the ring seal 14 when the spray head shifts to the active mode. FIG. 2 shows that the ring seal 14 gives additional security against leakage if for some reason the ring seal 23 does not seal tightly.

An upper portion 30 in the sleeve 6 is high enough for the ring seal 24 to bear fluid-tightly on the holder body 3.

The nozzle frame 1 and related components are not described here in greater detail, since suitable embodiments can be contemplated by a person skilled in the art.

It is feasible that the sleeve-like part 6 (and a passage 12) are omitted. In this case, with the pipe 4 pressurized, extinguishing fluid flows to the nozzles 2 of the spray head and to the space 29 between the nozzle frame 1 and the cover 13. After filling the space 29, the pressure of the extinguishing fluid makes the cover 13 come off. This kind of structure is very simple.

Reference numeral 28 denotes a fastening part for receiving the end of a chain or corresponding elongated element 49 whose other end is fastened near the spray head, for example to a pipeline. The element 49 prevents the cup 13 from being lost when the spray head shifts from the inactive to active mode.

Figure 4:
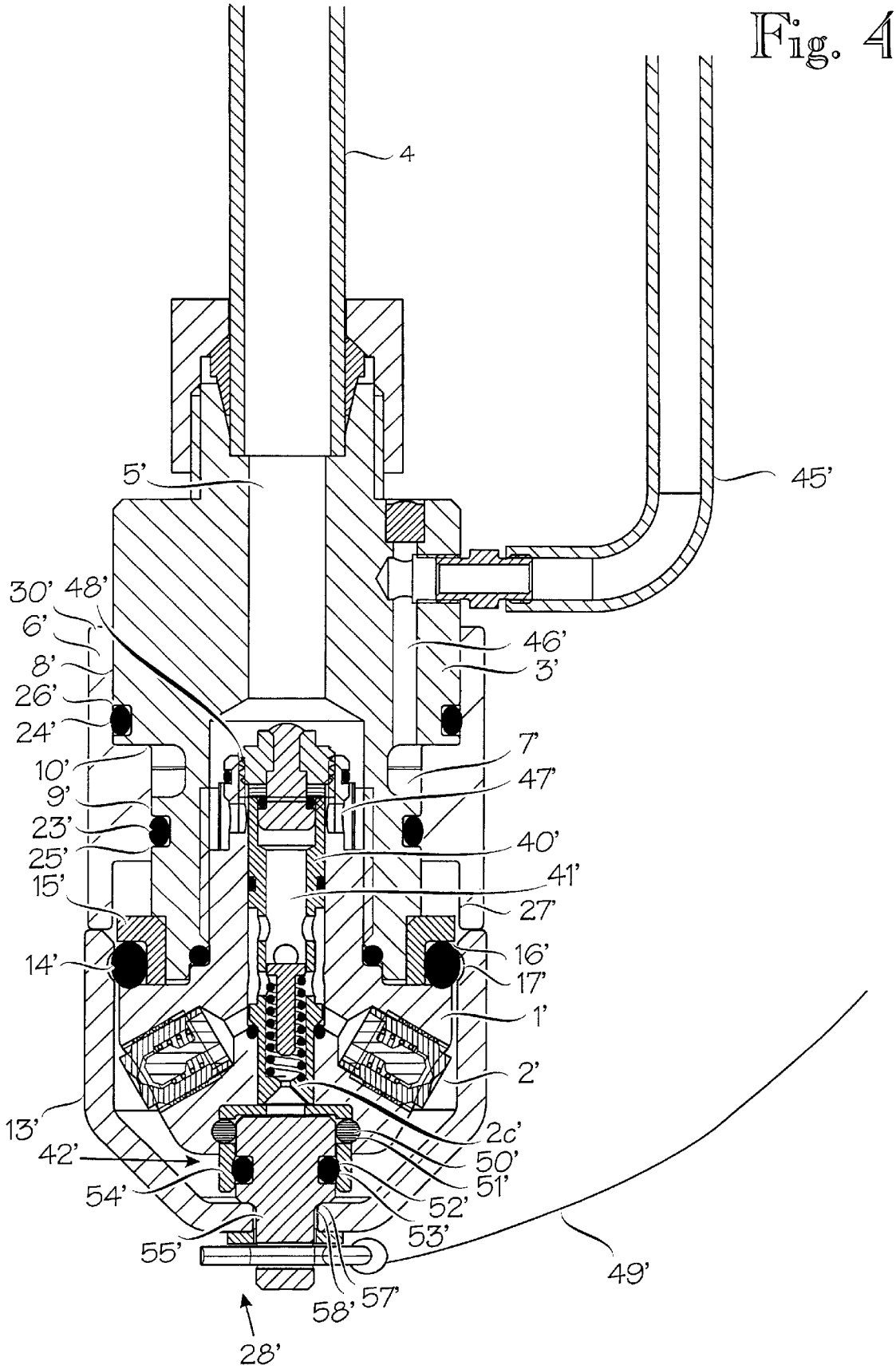
FIG. 4 shows another, extremely recommendable, embodiment of the spray head of the invention in an inactive mode.
Figure 5:
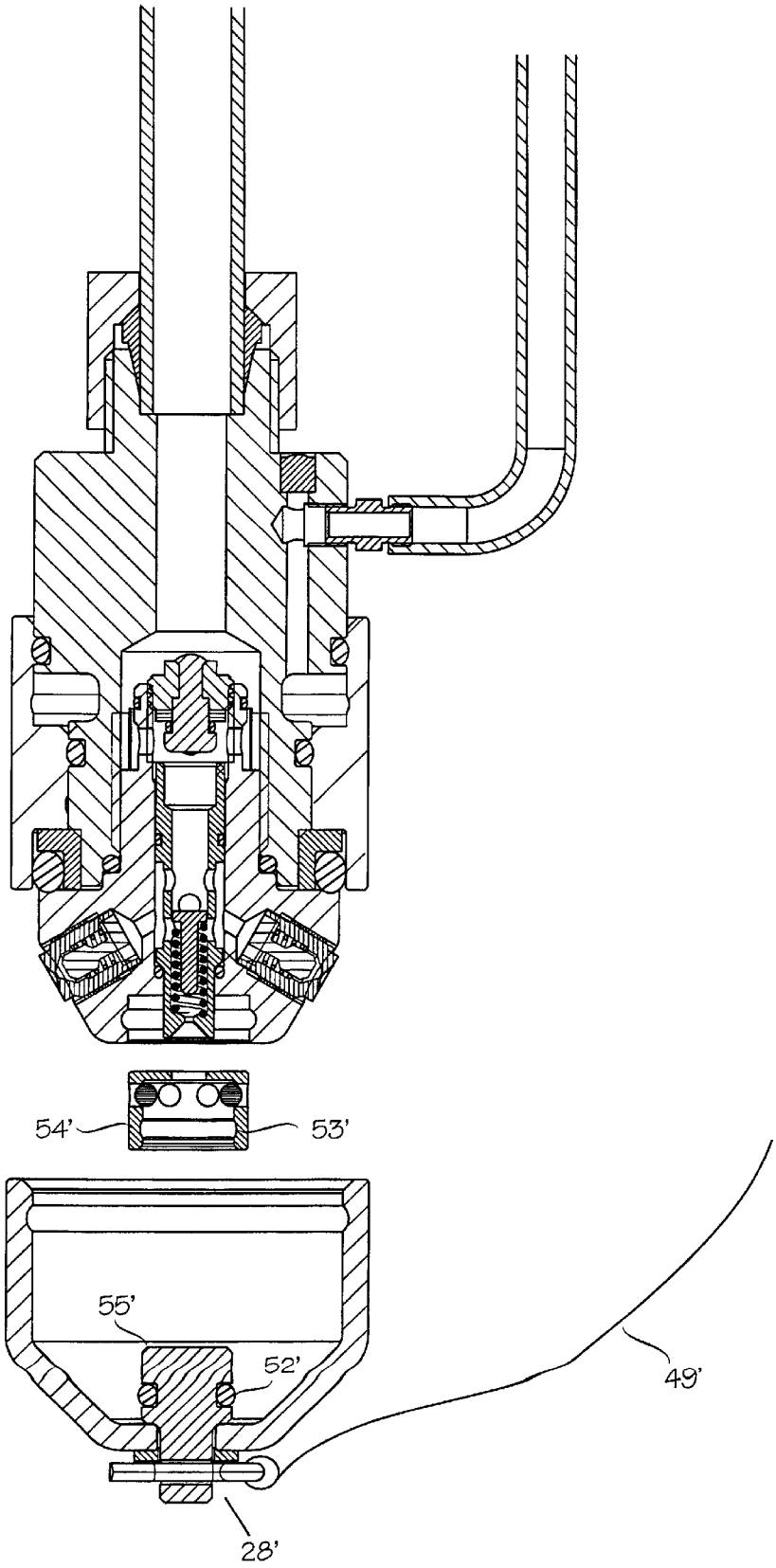
FIG. 5 shows the spray head of FIG. 4 in an active mode.

FIGS. 4 and 5 show another embodiment of the spray head in passive and active modes, respectively. Like numerals are employed in FIGS. 4 and 5 to designate like components in FIGS. 1 to 3. The nozzle frame 1' and related components, for example a displaceable spindle 40' loaded by means of a spring 48' and comprising a duct 41' for supplying extinguishing medium from the inlet 47' of the nozzle frame to the nozzles 2', 2'*c* can advantageously be of the pressure compensated (pressure balanced) type disclosed in publication WO 96/08291. The spray head does not have to be a pressure compensated spray head. A high pressure possibly acting in the inlet of the conduit leading to the nozzles 2' does not reach the nozzles before the spindle is displaced. Once the spindle is displaced, with a closing part 42' opening, a fluid communication between the inlet of the nozzle frame and the nozzles 2' is opened to allow them to spray extinguishing medium. The embodiment in FIG. 4 differs from that in FIG. 1 in that the spray head can be shifted (provided the pipe 4 contains pressurized extinguishing medium) from the passive (inactive) to active mode by a separate line 45' connected to the pressure chamber 7' via a passage 46' in the holder body 3'. Compared with the embodiment in FIG. 1, in certain application this would mean significant advantages which will be discussed below.

Accordingly, the pressure balanced spray head shown in FIG. 4 is preliminary activated/activated by means of a fluid pressure in the line 45', called a control line, the fluid not having to be in connection with the extinguishing medium in the pipe 4. Consequently, the fluid can be a gas. The fluid can also be the same as the extinguishing medium in the pipe 4, for example water. The fluid in the control line 45' is not in fluid communication with the inlet 5' when the spray head is in the inactive mode. In the active mode of the spray head, the control line 45' is/is not in fluid communication with the inlet, depending on the application. The advantage of the embodiment of FIG. 4 is that a fire extinguishing installation comprising separate or group-activated groups of spray heads can be provided at significantly lower costs than without a control line 45'. This is because the dimension of the control line 45' can be significantly smaller than that of the extinguishing medium supply line, and a valve (not shown) for controlling the flow of fluid to the control line can be significantly smaller than a valve which controls the flow of extinguishing medium to the pipe 4. Furthermore, the cover 13' can be temporally displaced depending on whether the pipe 4 is pressurized or not, i.e. independently of whether or not liquid is supplied to the nozzles. In addition, the spray head can be made to initially spray only when both the line 45' and the pipe 4 are pressurized. In case there is no liquid in the pipe 4, said preliminary activation is involved, indicating only that the cover 13' comes off. A spray head according to FIG. 4 can be used to construct a fire extinguishing system comprising a plurality of spray heads and a common pressurized extinguishing medium supply line (not shown), to which the pipes 4 of the spray heads are coupled, only the spray heads being released to whose control lines 45' fluid is supplied.

As mentioned above, the spray head does not have to be pressure balanced, particularly in a 'dry pipe' system, for example, in which extinguishing medium pressure does not initially act in the inlet. Non-pressure balanced spray heads can also be used in wet pipe systems on account of the closing part 42' which prevents the spindle 40' from being pressed downwards by the spring 48' when the spray head is in the passive mode and the cover 13' is on. Once the pressure chamber 7' is pressurized, the cover 13' and the closing part 42', fastened to the cover, are pressed downwards, resulting in the spindle 40' being pressed downwards by the force of the spring 48' and the extinguishing medium pressure, which is directed to the spindle. This way the spindle does not block the inlet 7' and extinguishing medium can flow from the inlet 5' via the conduit 41' to the nozzles 2', 2*c*'. With the spray head in the inactive mode shown in FIG. 4, the closing part 42' is kept in place in the nozzle frame 1' by means of locking means comprising a first locking part 54' and a second locking part 55'. The first locking part 54' is locked to the nozzle frame 1' by means of displaceable elements 50', for example metal spheres. The second locking part 55' is fastened to the first locking part 54' by means of an O ring 52' positioned in a cylindrical groove 53' in the second locking part 55' when the spray head is in the inactive mode. The O ring 52' holds the second locking part 55' in place in the first locking part 54', even though the cover 13' is not yet installed. Owing to this, the final installation of the spray head becomes simple; only the cover 13' has to be installed in the same place as the spray head is to be positioned, because the O ring 52' and the locking parts 54', 55' can be (completely) installed at the factory. The second locking part 55' is also fastened to an opening 58' in the cover 13'. A pin 28' or, in principle, any locking element can transfer the force from the cover 13' to the second locking part 55' such that it will move along once the cover is displaced. The shape of the second locking part 55' allows a support 57' to be formed against the opening 58' of the cover.

The elements 50' are arranged to be displaced in such a position that the first locking part 54' is released from the nozzle frame 1' when the second locking part 55' is displaced with respect to the first locking part. This takes place when the cover 13' is pressed downwards by means of pressure from the control line 45'. In this connection the spindle 40' presses the first locking part 55' out of the nozzle frame such that the spray head shifts to the active mode shown in FIG. 5.

The invention has been described above only with reference to examples. It should be noted that the details of the invention may vary in many respects within the scope of the attached claims as compared with the examples. Instead of a sleeve-like part 6, the use of another type of displaceable device is feasible, for example a piston device which under fluid pressure is displaced and opens the locking device which holds the cover in place.

What is claimed is:

1. A spray head comprising a holder body (3, 3'), at least one nozzle (2, 2', 2*c*') and a cover (13, 13') which in a protective position is arranged in front of said nozzle when the spray head is in an inactive mode, the spray head comprising means (6, 10, 6', 10') for providing a displacement of the cover from the protective position to a free position in which the cover keeps clear of the nozzle so that it can spray extinguishing medium when the spray head is in an active mode, the holder body comprising an inlet (5, 5') for incoming extinguishing medium, wherein the means for providing the displacement of the cover (13, 13') comprises a device (6, 6') which is displaceable with respect to the spray head and which is arranged by means of fluid pressure to exert a force on a locking device (14, 17, 14', 17') in the cover (13, 13') to make the locking device open and consequently displace the cover to said free position.

2. A spray head as claimed in claim 1, wherein during the displacement the cover (13, 13') is arranged to place the spray head in the active mode.

3. A spray head as claimed in claim 1, wherein the displaceable device (6, 6') comprises a projection area which is arranged to exert the force on the locking device (14, 17, 14', 17') under fluid pressure in a pressure chamber (7, 7').

4. A spray head as claimed in claim 3, wherein the displaceable device comprises a sleeve-like part (6, 6') which together with the holder body (3, 3') defines the pressure chamber (7, 7'), the sleeve-like part (6, 6') comprising the projection area in the area of the pressure chamber (7, 7').

5. A spray head as claimed in claim 3, wherein the pressure chamber (7') is in fluid communication with a control line (45') via a passage (46'), such that a fluid pressure in the control line (45') is arranged to provide said force against the locking device (14', 17').

6. A spray head as claimed in claim 5, wherein the control line (45') is not in fluid communication with the inlet (5') when the spray head is in the inactive mode.

7. A spray head as claimed in claim 3, wherein the pressure chamber (7) is in fluid communication with the inlet (5) via a passage (12) when the spray head is in the inactive mode, so that an extinguishing medium pressure in the inlet is arranged to provide said force against the locking device (14, 17).

8. A spray head as claimed in claim 5, wherein the sleeve-like part (6, 6') comprises a first cylindrical inner surface (9, 9') and a second cylindrical inner surface (8, 8') in the area of the pressure chamber (7, 7'), the first cylindrical inner surface having a larger diameter than the second cylindrical inner surface such that a shoulder (10, 10') forms between said cylindrical inner surfaces, the shoulder defining said projection area as a ring area.

9. A spray head as claimed in claim 8, wherein the sleeve-like part (6, 6') is sealed against the holder body (3, 3') by a sealing means (23, 24, 23', 24') in such a manner that the fluid supplied to the pressure chamber (7, 7') cannot flow out of the pressure chamber past the sleeve-like part.

10. A spray head as claimed in claim 9, wherein said sealing means comprises a first ring seal (23, 23') positioned in the first cylindrical inner surface (9, 9') and a second ring seal (24, 24') positioned in the second cylindrical inner surface (8, 8').

11. A spray head as claimed in claim 10, wherein the first and second ring seals (23 and 24, 23' and 24', respectively) are positioned in corresponding ring grooves (25 and 26, 25' and 26', respectively) in the holder body (3, 3').

12. A spray head as claimed in claim 4, wherein the sleeve-like part (6, 6') comprises a stop (19, 19') arranged to come into contact with a blocking part (15, 15') which is stationary with respect to the holder body (3, 3') for restricting the displacement of the sleeve-like part with respect to the holder body.

13. A spray head as claimed in claim 1, wherein the cover (13, 13') is arranged fluid-tight against the spray head by means of a third seal (14, 14').

14. A spray head as claimed in claim 13, wherein the third seal is composed of a ring seal (14, 14') for which the cover (13, 13') comprises a cylindrical groove by means of which groove and ring seal the cover is kept in place in the protective position.

15. A spray head as claimed in claim 14, wherein the sleeve-like part (6, 6') comprises a third cylindrical inner surface (27, 27') which is arranged by means of the ring seal (14, 14') to bear tightly on the spray head when the spray head is displaced to the active mode.

16. A spray head as claimed in claim 1, wherein the cover is formed as a cup (13, 13') and comprises a fastening part (28, 28') for receiving a fastening end of a flexible elongated element (49, 49').

17. A spray head as claimed in claim 1, wherein the spray head comprises a nozzle frame (1, 1') which is detachedly fastened to the holder body (3, 3').

18. A spray head as claimed in claim 1, wherein the spray head comprises a spindle (40') which is arranged displaceable in the nozzle frame (1') such that a fluid communication between the inlet (5') and at least one nozzle (2') opens when the spindle is displaced.

19. A spray head as claimed in claim 18, wherein the spindle (40') is arranged to be supported against a closing part (42') which is arranged to be displaced with the cover (13') when the cover is displaced from the protective position to the free position and which is arranged by means of locking means (50', 51', 52', 53') to keep the spindle in a position which blocks the fluid communication between the inlet (5') and the nozzle (2') when the spray head is in the inactive mode.

20. A spray head as claimed in claim 19, wherein the locking means comprises a first locking part (54') which is fastened to the nozzle frame (1') by means of displaceable elements (50') and a second locking part (55'), whereby the displaceable elements are arranged to be displaced in a position which releases the first locking part from the nozzle frame when the second locking part is displaced with respect to the first locking part.

21. A spray head as claimed in claim 20, wherein the second locking part (55') is fastened to the first locking part (54') by means of an O ring (52') positioned in a cylindrical groove (53') when the spray head is in the inactive mode.

22. A spray head as claimed in claim 21, wherein the second locking part (55') is fastened to the cover (13').

23. A spray head as claimed in claim 18, wherein the lower end of the spindle (40') comprises a central nozzle (**2*c*') which in the active mode of the spray head is in fluid communication with the inlet (5'**) but which is blocked in the inactive mode of the spray head.

24. A spray head as claimed in claim 23, wherein spray head is a pressure balanced spray head.

25. A spray head as claimed in claim 23, wherein the spindle (40') comprises a conduit (41') for supplying extinguishing medium from the inlet (5') to the central nozzle (**2*c*'**).

26. A spray head as claimed in claim 23, comprising a number of nozzles (2') obliquely positioned with respect to the central nozzle (**2*c*'), wherein the spindle (40') is arranged to block a fluid communication between the obliquely positioned nozzles (2') and the inlet (5') when the spray head is in the inactive mode, and is arranged to open the fluid communication to the obliquely positioned nozzles (2'**) when the spray head is in the active mode.

* * * * *